US009268300B2

(12) United States Patent
Shimizu et al.

(10) Patent No.: US 9,268,300 B2
(45) Date of Patent: Feb. 23, 2016

(54) PROCESS UNIT INCLUDING A ROTATABLE SHAFT ALONG A DRIVING FORCE VECTOR AND IMAGE FORMING APPARATUS INCLUDING THE SAME

(71) Applicants: Yoshiyuki Shimizu, Osaka (JP); Hirobumi Ooyoshi, Kanagawa (JP); Manabu Hamada, Osaka (JP)

(72) Inventors: Yoshiyuki Shimizu, Osaka (JP); Hirobumi Ooyoshi, Kanagawa (JP); Manabu Hamada, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 132 days.

(21) Appl. No.: 13/770,086

(22) Filed: Feb. 19, 2013

(65) Prior Publication Data

US 2013/0216264 A1 Aug. 22, 2013

(30) Foreign Application Priority Data

Feb. 22, 2012 (JP) ..... 2012-036397
Nov. 28, 2012 (JP) ..... 2012-259981

(51) Int. Cl.
*G03G 15/00* (2006.01)
*G03G 21/18* (2006.01)

(52) U.S. Cl.
CPC ..... *G03G 21/1814* (2013.01); *G03G 21/1821* (2013.01); *G03G 21/1857* (2013.01)

(58) Field of Classification Search
CPC ..... G03G 21/1814; G03G 21/1821; G03G 21/1857
USPC ..... 399/111, 113, 167
See application file for complete search history.

(56) References Cited

U.S. PATENT DOCUMENTS

| | | | | |
|---|---|---|---|---|
| 5,258,811 | A * | 11/1993 | Miyake et al. | 399/167 |
| 5,268,718 | A * | 12/1993 | Maeda et al. | 399/75 |
| 5,450,166 | A * | 9/1995 | Yashiro | 399/111 |
| 5,950,048 | A * | 9/1999 | Okumura et al. | 399/113 |
| 5,970,286 | A * | 10/1999 | Numazu et al. | 399/167 |
| 6,397,026 | B1 * | 5/2002 | Buxton et al. | 399/111 |
| 6,542,706 | B2 * | 4/2003 | Toba et al. | 399/111 |
| 6,636,712 | B2 * | 10/2003 | Shimaoka | 399/113 |
| 6,671,477 | B2 * | 12/2003 | Komatsu et al. | 399/113 |
| 7,184,686 | B2 * | 2/2007 | Kanno et al. | 399/111 |
| 7,327,970 | B2 * | 2/2008 | Moon | 399/111 |
| 7,869,742 | B2 | 1/2011 | Igarashi et al. | |
| 7,965,957 | B2 | 6/2011 | Kubota et al. | |
| 7,995,949 | B2 | 8/2011 | Shimizu | |

(Continued)

FOREIGN PATENT DOCUMENTS

| | | |
|---|---|---|
| JP | 05-066658 | 3/1993 |
| JP | 05-066662 | 3/1993 |
| JP | 2000-298397 | 10/2000 |

(Continued)

*Primary Examiner* — G. M. Hyder
(74) *Attorney, Agent, or Firm* — Harness, Dickey & Pierce

(57) ABSTRACT

A process unit includes a photosensitive member that carries an image; a developing device that has a developer carrying member carrying a developer to be supplied to the photosensitive member; a rotating shaft that supports the developing device rotatably for approaching and separating from the photosensitive member; a photosensitive member gear provided to the photosensitive member; and a developing gear provided to the developer carrying member. The photosensitive member gear and the developing gear engage together and driving force can be transmitted, and the rotating shaft is placed on a driving force vector between the gears or on an extended line thereof, the driving force vector being generated from engagement between the photosensitive member gear and the developing gear.

17 Claims, 12 Drawing Sheets

(56) References Cited

U.S. PATENT DOCUMENTS

| | | | | |
|---|---|---|---|---|
| 8,055,169 | B2 | 11/2011 | Ebe | |
| 8,260,186 | B2 | 9/2012 | Kubota et al. | |
| 8,275,285 | B2 | 9/2012 | Kawakami et al. | |
| 8,326,203 | B2 | 12/2012 | Ooyoshi | |
| 2003/0068172 | A1* | 4/2003 | Komatsu et al. | 399/113 |
| 2005/0013627 | A1* | 1/2005 | Jeon | 399/111 |
| 2008/0145119 | A1 | 6/2008 | Tatsumi et al. | |
| 2009/0052960 | A1* | 2/2009 | Tanaka et al. | 399/358 |
| 2013/0100225 | A1* | 4/2013 | Kodo | 347/224 |

FOREIGN PATENT DOCUMENTS

| | | |
|---|---|---|
| JP | 2001-175046 | 6/2001 |
| JP | 2003-015470 | 1/2003 |
| JP | 3982724 | 9/2007 |
| JP | 2008-292940 | 12/2008 |
| JP | 2010-026541 | 2/2010 |
| JP | 2012-013899 | 1/2012 |

* cited by examiner

PROCESS UNIT INCLUDING A ROTATABLE SHAFT ALONG A DRIVING FORCE VECTOR AND IMAGE FORMING APPARATUS INCLUDING THE SAME

BACKGROUND OF THE INVENTION

1. Field of the Invention

The present invention relates to a process unit and an image forming apparatus.

2. Description of the Related Art

In an image forming apparatus of an electrophotographic type, such as a copier, a printer, a facsimile machine, a multifunction peripheral having the respective functions thereof, or the like, a developing device is provided for visualizing a latent image formed on a photosensitive member. Generally speaking, the developing device has a developing roller as a developer carrying member for carrying a toner that is a developer, a supply roller that supplies the toner to the developing roller, a control blade controlling the thickness of the toner on the developing roller into a uniform thickness, and so forth.

Basic operations of the developing device are as follows. First, the toner contained inside the developing device is electrified by friction caused as a result of the supply roller and the developing roller being rubbed together at a nip therebetween, and the toner adheres to the surface of the developing roller by the image force of the electric charge generated by the electrification. Next, when the toner carried by the developing roller reaches a control nip at which the developing roller and the control blade come into contact together, the thickness of the toner is controlled by the control blade to be a uniform thickness, and electric charge is given to the toner. Then, at a developing area between the photosensitive member and the developing roller, the toner on the developing roller is transferred, by a developing electric field, to a latent image formed on the photosensitive member, and the latent image is thus visualized into a toner image. Thus, a desired image is obtained as a result of transfer of the toner being carried out satisfactorily from the supply roller to the developing roller, and from the developing roller to the photosensitive member. Further, for the purpose of stably obtaining a satisfactory image, it is necessary to stabilize the relative position of the developing roller with respect to the photosensitive member.

For example, in an image forming apparatus disclosed in Japanese Laid-Open Patent Application No. 5-66662 (Patent Reference No. 1), a developing device that is rotatably supported has force applied thereto toward a photosensitive member, thus a developing roller is made to come into contact with the photosensitive member via a spacer, and the space between the photosensitive member and the developing roller is made to be constant.

Further, in the image forming apparatus of Patent Reference No. 1, a first gear provided to the developing roller and a second gear provided to the photosensitive member are made to engage together for the purpose of transferring driving force of a motor provided in an apparatus body to the photosensitive member and the developing roller.

However, in the case where the driving force is transferred between the developing device that is rotatably supported and the photosensitive member that is fixed in its position, the developing device may be moved in such a direction that it is rotated because of driving force generated between the gears, and thus, the relative position between the photosensitive member and the developing device may be changed.

SUMMARY OF THE INVENTION

According to one aspect of the present invention, a process unit includes a photosensitive member carrying an image; a developing device having a developer carrying member that carries a developer to be supplied to the photosensitive member; a rotating shaft supporting the developing device rotatably for allowing the developer carrying member to approach and separate from the photosensitive member; a photosensitive member gear provided to the photosensitive member; and a developing gear provided to the developer carrying member. In the process unit, the photosensitive member gear and the developing gear engage together and driving force can be transmitted, and the rotating shaft is placed on a driving force vector between the gears or on an extended line thereof, the driving force vector being generated from engagement between the photosensitive member gear and the developing gear.

Other objects, features and advantages of the present invention will become more apparent from the following detailed description when read in conjunction with the accompanying drawings.

DETAILED DESCRIPTION OF THE EMBODIMENTS

Figure 1:
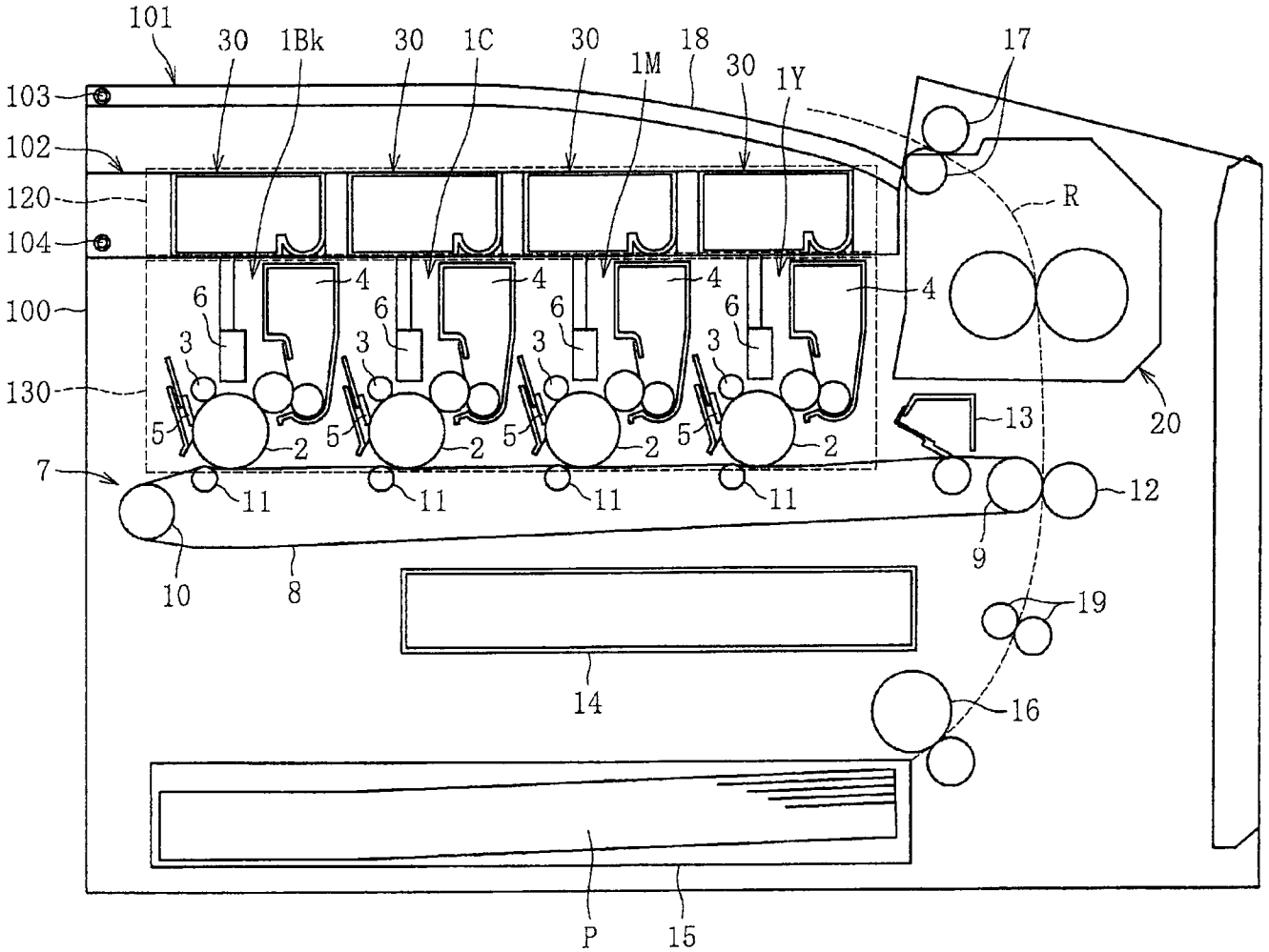
FIG. 1 shows a general configuration of a color printer as an image forming apparatus according to an embodiment of the present invention.

Below, based on the drawings, embodiments of the present invention will be described. It is noted that in the respective drawings illustrating the embodiments of the present invention, for elements such as members/components having the same functions or same shapes, the same reference numerals are given as long as they can be distinguished, and duplicate description will be omitted.

First, the entire configuration and operations of a color printer as an embodiment of the present invention will be described using FIG. 1. However, the present invention is not limited thereto. The present invention may be applied to an image forming apparatus such as a monochrome printer, another printer, a copier, a facsimile machine, a multifunction peripheral having the respective functions thereof, or the like.

As shown in FIG. 1, in an apparatus body (image forming apparatus body) 100 of the color printer, four process units 1Y, 1M, 1C and 1Bk as image forming units are detachably loaded. The respective process units 1Y, 1M, 1C and 1Bk have uniform configurations except that they contain toners of different colors, i.e., yellow (Y), magenta (M), cyan (C) and black (Bk), corresponding to color separation components of a color image.

Specifically, the process units 1Y, 1M, 1C and 1Bk include photosensitive members 2; electrification rollers 3 as electrification parts electrifying surfaces of the photosensitive members 2; developing devices 4 as developing parts visualizing latent images formed on the photosensitive members 2; and cleaning blades 5 as cleaning parts cleaning the surfaces of the photosensitive members 2, respectively. Exposure devices 6 exposing the surfaces of the photosensitive members 2, respectively, are provided at positions facing the photosensitive members 2, respectively. In the embodiment, as the exposure devices 6, LED units are used.

Above the respective developing devices 4, toner cartridges 30 as powder containers containing toners that are powder for forming an image are detachably loaded. In the respective toner cartridges 30, toners of the same colors as the toners included in the corresponding developing devices 4 are contained. When the toners in the developing devices 4 have been reduced to be less than predetermined amounts, the toners are supplied from the toner cartridges 30. It is noted that in the embodiment, monocomponent developers including toners for forming an image are used. However, the toners are not limited thereto. The present invention can be applied also to a configuration using two-component developers including toners and carriers.

Below the respective photosensitive members 2, a transfer device 7 is provided. The transfer device 7 has an intermediate transfer belt 8 that includes an endless belt as an intermediate transfer member. The intermediate transfer belt 8 is hung between a driving roller 9 and a driven roller 10 (as supporting members). As a result of the driving roller 9 being rotated counterclockwise of FIG. 1, the intermediate transfer belt 8 is made to run around (is rotated).

At positions facing the respective photosensitive members 2, primary transfer rollers 11 as primary transfer parts are provided, respectively. The respective primary transfer rollers 11 are pressed onto the inner surface of the intermediate transfer belt 8 at respective positions, and primary transfer nips are formed at the positions where the pressed parts of the intermediate transfer belt 8 and the respective photosensitive members 2 come into contact together. The respective primary transfer rollers 11 are connected with a power source not shown, and a predetermined direct current voltage (DC) and/or alternate current voltage (AC) is applied to the primary transfer rollers 11.

At a position facing the driving roller 9, a secondary transfer roller 12 as a secondary transfer part is provided. The secondary transfer roller 12 is pressed onto the outer surface of the intermediate transfer belt 8, and a secondary nip is formed at a position at which the secondary transfer roller 12 and the intermediate transfer belt 8 come into contact together. Further, the same as the primary transfer rollers 11, the secondary transfer roller 12 is connected with a power source, and a predetermined direct current voltage (DC) and/or alternate current voltage (AC) is applied to the secondary transfer roller 12.

On the outer surface of the intermediate transfer belt 8 near the right end thereof in FIG. 1, a belt cleaning device 13 is provided for cleaning the surface of the intermediate transfer belt 8. A waste toner transfer hose (not shown) extended from the belt cleaning device 13 is connected to an inlet part of the waste toner container 14 provided below the transfer device 7.

At a lower part of the apparatus body 100, a paper supply tray 15 containing paper P as recording media, a paper supply roller 16 supplying paper P from the paper supply tray 15 and so forth are provided. Specific examples of the paper P include cardboards, postcards, envelopes, plain paper, thin paper, coated paper (including art paper) and tracing paper. Further, it is also possible to use, as the recording media, transparencies/viewgraphs (OHP sheets/OHP films), and so forth.

At an upper part of the apparatus body 100, a pair of paper ejecting rollers 17 for ejecting the paper externally, and a paper ejecting tray 18 for placing the paper ejected by the paper ejecting rollers 17 are provided.

Further, inside the apparatus body 100, a conveyance path R is provided for conveying the paper P from the paper supply tray 15 to the paper ejecting tray 18 through a secondary transfer nip. On this conveyance path R, a pair of registration rollers 19 as timing rollers is provided on the paper-conveyance-direction upstream side of the position of the secondary transfer roller 12. The pair of registration rollers 19 conveys the paper to the secondary transfer nip while controlling the conveyance timing. Further, on the paper-conveyance-direction downstream side of the position of the secondary transfer roller 12, a fixing device 20 for fixing an image onto a sheet of the paper P is provided.

Next, using FIG. 1, basic operations of the printer according to the present embodiment will be described.

When image forming operations are started, the photosensitive members 2 of the respective process units 1Y, 1M, 1C and 1B are rotated clockwise of FIG. 1, respectively, and the surfaces of the respective photosensitive members 2 are uniformly electrified by the electrification rollers 3 to a predetermined polarity. Based on image information of an original that has been read by an image reading device (not shown), LED light is emitted by the exposure devices 6 to the electrified surfaces of the respective photosensitive members 2, and electrostatic latent images are formed on the surfaces of the respective photosensitive members 2. At this time, sets of image information with which the respective photosensitive members 2 are exposed are sets of image information of single colors obtained from separating a desired full-color image into sets of color information of yellow, magenta, cyan and black. Toners are supplied to the electrostatic latent images thus formed on the photosensitive members by the respective developing devices 4, and thus, the electrostatic latent images are visualized into toner images.

Further, when the image forming operations are thus started, the driving roller 9 is rotated, and thus, the intermediate transfer belt 8 hung on the driving roller 9 is made to run around. Further, as a result of a constant voltage or a voltage controlled by a constant current of the polarity opposite of the electrification polarity of the toners being applied to the respective primary transfer rollers 11, transfer electric fields are generated at primary transfer parts between the respective primary transfer rollers 11 and the respective photosensitive members 2.

Thereafter, when the toner images of the respective colors on the photosensitive members 2 reach the primary transfer parts as a result of the respective photosensitive members 2 being rotated, the toner images on the respective photosensitive members 2 are transferred to the intermediate transfer belt 8 in sequence in a manner of being overlaid together by the above-mentioned transfer electric fields generated at the primary transfer parts. Thus, a full-color toner image is formed on the surface of the intermediate transfer belt 8. Further, the toners left on the respective photosensitive members 2 untransferred to the intermediate transfer belt 8 are removed by the cleaning blades 5.

At the lower part of the apparatus body 100, the paper supply roller 16 is started to be driven to be rotated, and a sheet of paper P is sent out from the paper supply tray 15 to the conveyance path R. The conveyance of the sheet of paper P is stopped for a while by the registration rollers 19.

Thereafter, at predetermined timing, the registration rollers 19 are started to be driven and rotated, and the sheet of paper P is conveyed to the secondary transfer nip in synchronization with arrival of the toner image on the intermediate transfer belt 8 at the secondary transfer nip. At this time, to the secondary transfer roller 12, a transfer voltage having the polarity opposite to the toner electrified polarity of the toner image on the intermediate transfer belt 8 is applied. Thereby, a transfer electric field is generated at the secondary transfer nip. By the transfer electric field, the toner image on the intermediate transfer belt 8 is transferred to the sheet of paper P as a whole. The residual toner on the intermediate transfer belt 8 untransferred to the sheet of paper P is removed by the cleaning device 13, and the removed toner is conveyed to the waste toner container 14 and is collected there.

Thereafter, the sheet of paper P on which the toner image has been thus transferred is conveyed to the fixing device 20, and the toner image on the sheet of paper P is fixed to the sheet of paper P by the fixing device 20. Then, the sheet of paper P is ejected to the outside of the apparatus by the pair of paper ejecting rollers 17, and is placed in the paper ejecting tray 18.

The above description is for the image forming operations for when the full-color image is formed on the sheet of paper. However, it is also possible to form an image of a single color using any one of the four process units 1Y, 1M, 1C and 1Bk, or form an image of two or three colors using any two or three of the process units.

Figure 2:
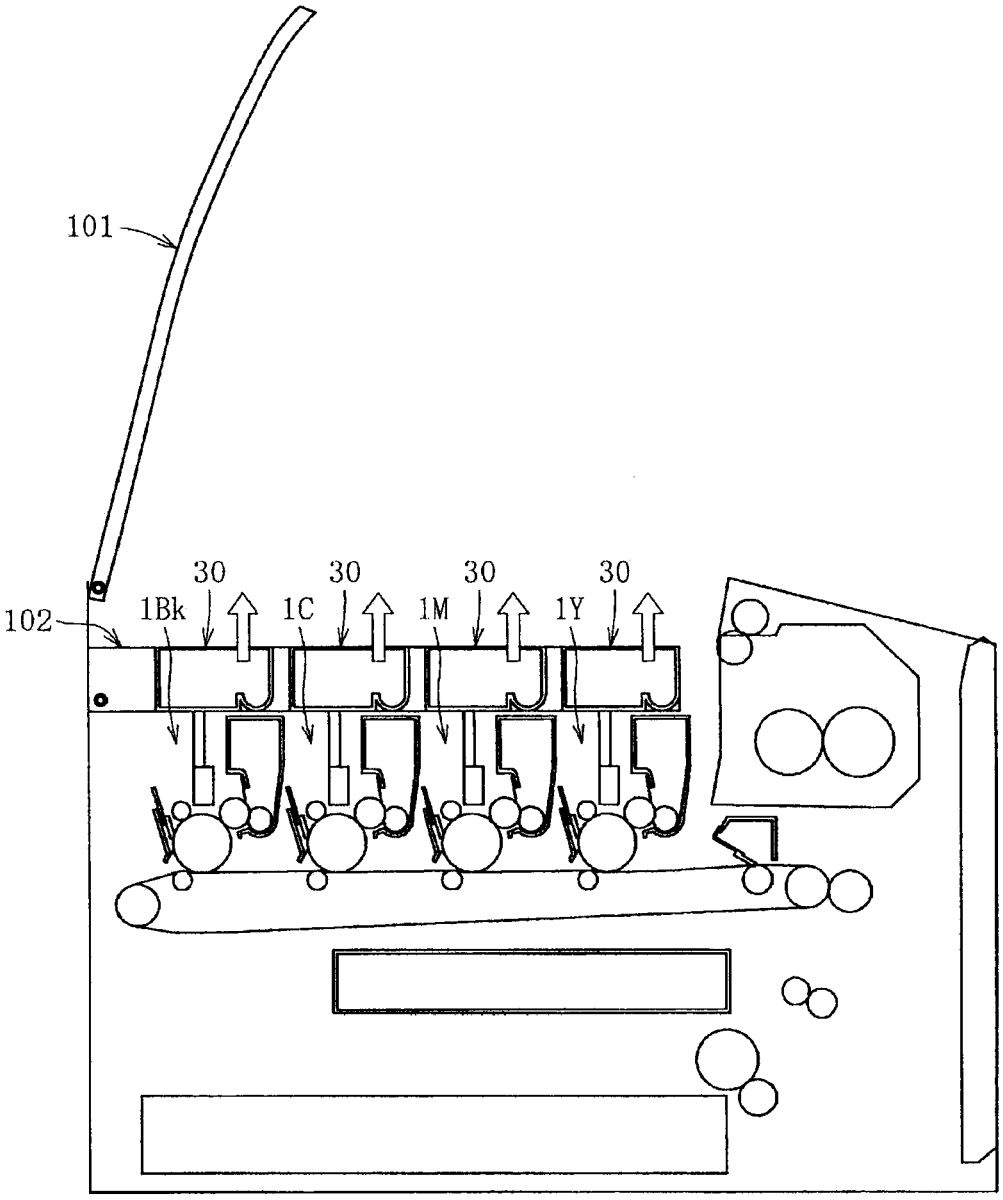
FIG. 2 shows a state of an upper cover being opened.

Further, the printer of the present embodiment includes an upper cover 101 as a first cover provided at the top of the apparatus body 100 and an intermediate cover 102 as a second cover provided inside (below) the upper cover 101. The upper cover 101 and the intermediate cover 102 are configured to be openable and closable as a result of being rotated about supporting shafts 103 and 104 provided to the apparatus body 100, respectively. FIG. 2 shows a state of the upper cover 101 being opened, and FIG. 3 shows a state of the intermediate cover 102 being opened.

In the intermediate cover 102, a container loading part 120 is provided for being able to load the plural toner cartridges 30. Further, in a unit loading part 130 provided inside (below) the intermediate cover 102, the process units 1Y, 1M, 1C and 1Bk of the respective colors can be contained.

As shown in FIG. 2, after opening the upper cover 101, the respective toner cartridges 30 can be loaded into and removed from the intermediate cover 102 from the top.

Figure 3:
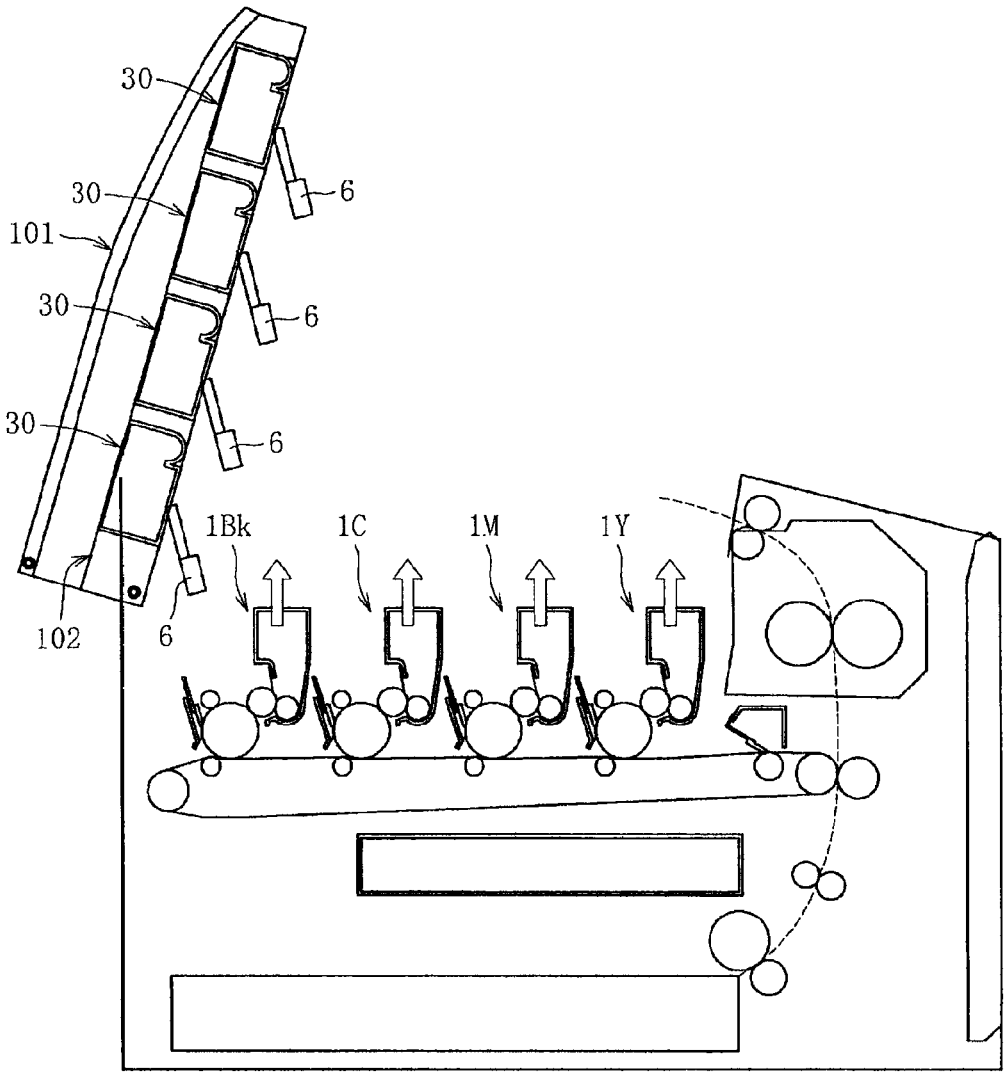
FIG. 3 shows a state of the upper cover and an intermediate cover being opened.

Further, after opening the intermediate cover 102 as shown in FIG. 3, it is possible to integrally withdraw the respective toner cartridges 30 from the top of the process units 1Y, 1M, 1C and 1Bk. Further, at this time, the respective exposure devices 6 are withdrawn together with the intermediate cover 102 from the top of the respective photosensitive members 2. Thus, the respective process units 1Y, 1M, 1C and 1Bk come to be able to be removed and loaded from the top. Thus, according to the present embodiment, it is possible to load and remove the process units 1Y, 1M, 1C and 1Bk without removing the toner cartridges 30 from the intermediate cover 102. Thus, the replacement workability is superior.

Figure 4:
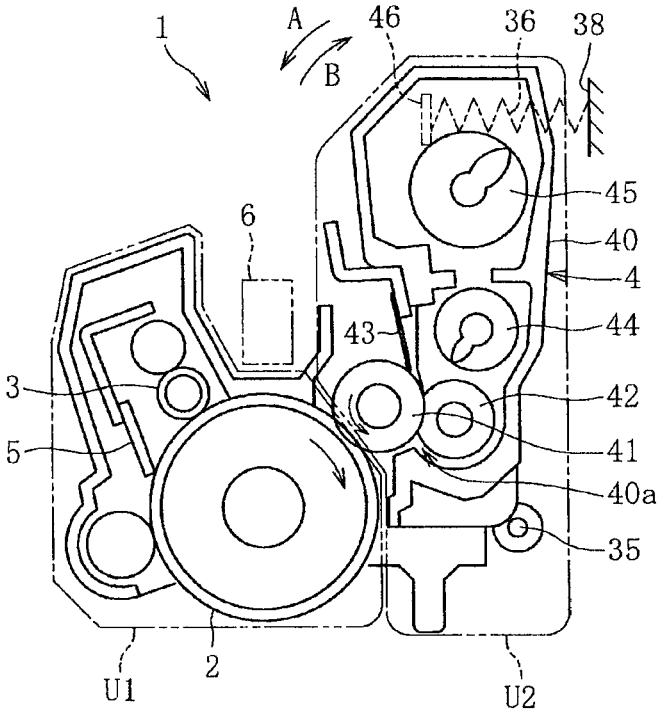
FIG. 4 shows a sectional view of a process unit.

FIG. 4 is a sectional view of the process unit.

According to the present embodiment, the process unit 1 (each one of 1Y, 1M, 1C and 1Bk) includes generally two modules. One thereof is a photosensitive member unit (first unit) U1 including the photosensitive member 2, the electrification roller 3 and the cleaning blade 5. The other is a developing unit (second unit) U2 including the developing device 4.

The developing unit U2 (developing device 4) includes a developing housing 40 that houses the toner and so forth; a developing roller 41 as a developer carrying member that carries the toner; a supply roller 42 as a developer supply member that supplies the toner; a control blade 43 as a control member that controls the thickness of the toner being carried by the developing roller 41; a conveyance screw 44 as a conveyance member that conveys the toner; and an agitator 45 as a stirring member that stirs the toner.

An opening 40*a* is formed at a lower part of the developing housing 40 facing the photosensitive member 2, and the developing roller 41 is rotatably provided in the opening 40*a*. The developing roller 41 has a core metal made of a metal; a resilient layer made of a resilient member or a foamed resilient member provided on the periphery of the core metal; and a surface layer (resin coated layer) made of acrylic resin, silicone resin or the like provided on the periphery of the resilient layer. It is noted that the developing roller 41 may be one not having the surface layer.

The supply roller 42 is made of a sponge roller in which, on the periphery of a core metal made of a metal, a resilient layer made of a foamed resilient member is provided. Specific examples of the material of the foamed resilient member include a flexible urethane foam, a silicone and a foamed polymer. It is also possible to adjust the resistance value by adding a conductive material or so to such a material. The supply roller 42 is in contact with the developing roller 41, and a nip (hereinafter, referred to as a supply nip) is formed between these rollers 41 and 42.

The control blade 43 is made of a metal plate such as SUS having the thickness on the order of 0.1 mm. The extending end of the control blade 43 comes into contact with the surface of the developing roller 41, and forms a nip (hereinafter, referred to as a control nip).

Upon an instruction to start the image forming operations being given, the toner inside the developing housing 40 is stirred by the agitator 45, and is supplied to the supply roller 42 by the conveyance screw 44. The toner supplied to the supply roller 42 is supplied to the surface of the developing roller 41 after being electrified through friction caused by rubbing between the supply roller 42 and the developing roller 41 at the supply nip.

The toner thus provided to the surface of the developing roller 41 passes through the control nip of the control blade 43, and thus the thickness of the toner is controlled. Simultaneously, through the friction there, the toner layer is electrified. Then, when the toner on the surface of the developing roller 41 has been conveyed to a position (a developing area) at which the developing roller 41 faces the photosensitive member 2, the toner is transferred to the latent image formed on the photosensitive member 2 by the force of the electric field generated between the photosensitive member 2 and the developing roller 41. Thus, the toner image is formed.

As shown in FIG. 4, the developing unit U2 (developing device 4) is rotatably (in an A direction and a B direction) supported by a rotating shaft 35. Thus, the developing roller 41 is movable in the directions of approaching and separating from the photosensitive member 2. Further, the developing unit U2 is pressed in the A direction by a pressing spring 36 as a force applying part.

Figure 5:
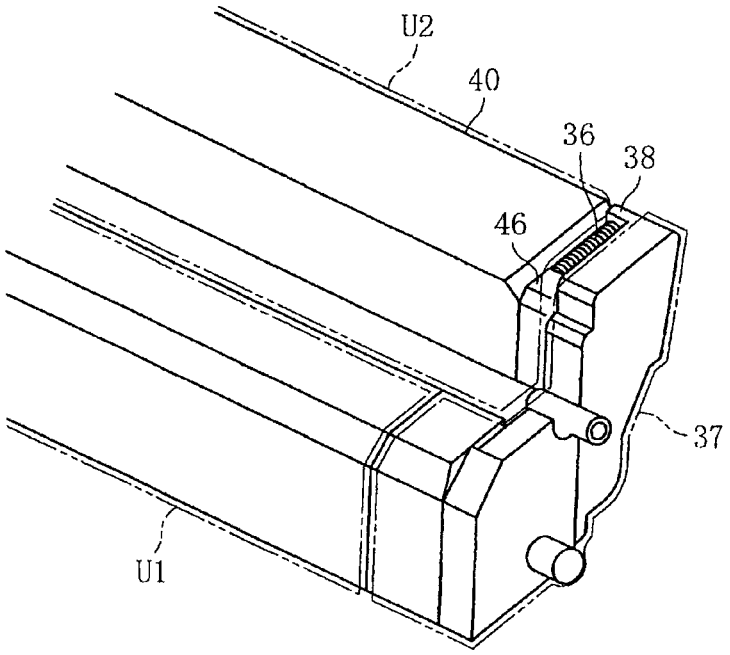
FIG. 5 shows an external appearance of one end of the process unit.

According to the present embodiment, as shown in FIG. 5, a side plate 37 is provided on the respective side walls of the photosensitive member unit U1 and the developing unit U2 for supporting them. The pressing spring 36 is provided between the side plate 37 and the developing unit U2. In more detail, one end of the pressing spring 36 is attached to a receiving part 46 provided on the side of the developing unit U2 (developing device 40) and the other end of the pressing spring 36 is attached to a receiving part 38 provided on the side plate 37.

By the pressing force of the pressing spring 36, the developing roller 41 comes into contact with the photosensitive member 2, and a nip (hereinafter, referred to as a developing nip) is formed between the developing roller 41 and the photosensitive member 2. It is noted that the present invention is applicable not only to the case where the developing roller 41 is in contact with the photosensitive member 2, but also a case where the developing roller 41 is placed with a space between the developing roller 41 and the photosensitive member 2 using a spacer or the like. Further, although the pressing spring 36 is used in the present embodiment for applying force to the developing unit U2, it is also possible to instead use a pulling spring or the like and apply force to the developing unit U2 in the same or similar direction.

Figure 6:
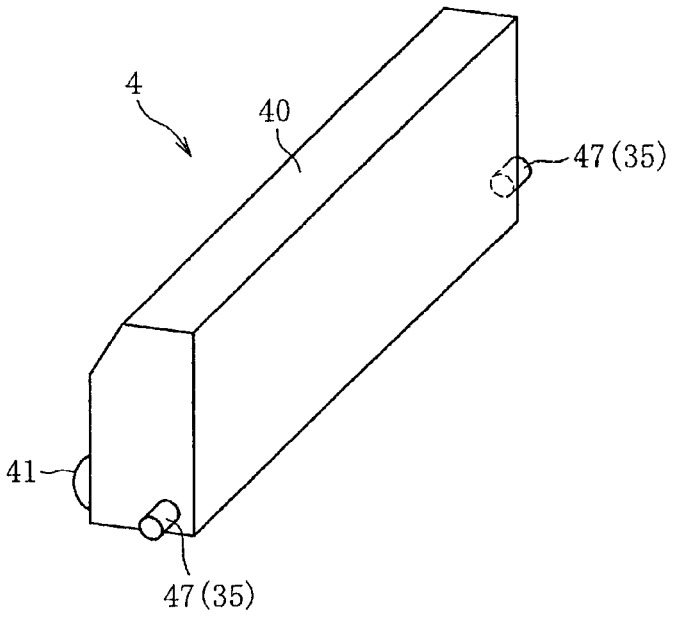
FIG. 6 shows an external appearance of a developing device having a pair of bosses or pins as a rotating shaft provided thereto.

FIG. 6 shows an external appearance in which the developing device is simplified.

As shown in FIG. 6, according to the present embodiment, projections 47 are provided which are made of a pair of bosses, driven pins or the like on the respective end faces of the developing housing 40. These projections 47 are used as the rotating shaft 35. Further, the respective projections 47 are rotatably supported by bearings (not shown) provided on the above-mentioned side plates 37 of the process unit 1.

Figure 7:
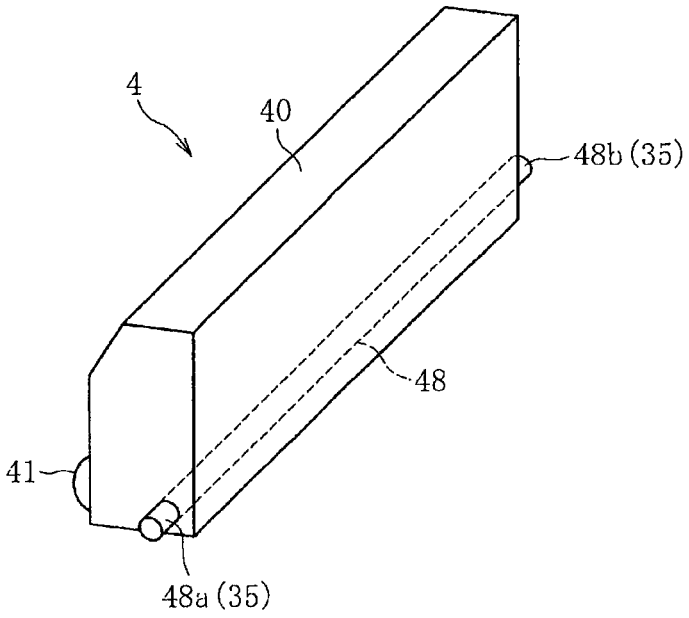
FIG. 7 shows an external appearance of a developing device having a passing through shaft as a rotating shaft provided thereto.

Alternatively, it is also possible that, as shown in FIG. 7, a shaft 48 passing through the developing housing 40 may be provided, and the respective end parts 48*a* and 48*b* of the shaft 48 projecting from the developing housing 40 may be used as the rotating shaft 35.

Conversely, it is also possible to provide rotating shafts 35 on the side plates 37, and provide bearings receiving the rotating shafts 35 on the developing device 4. However, from a viewpoint of making assembling work of the process unit 1 easier, it is preferable to provide the rotating shaft 35 on the developing device 4.

Next, based on FIG. 8, a driving system for the photosensitive member 2 and the developing roller 41 will be described.

Figure 8:
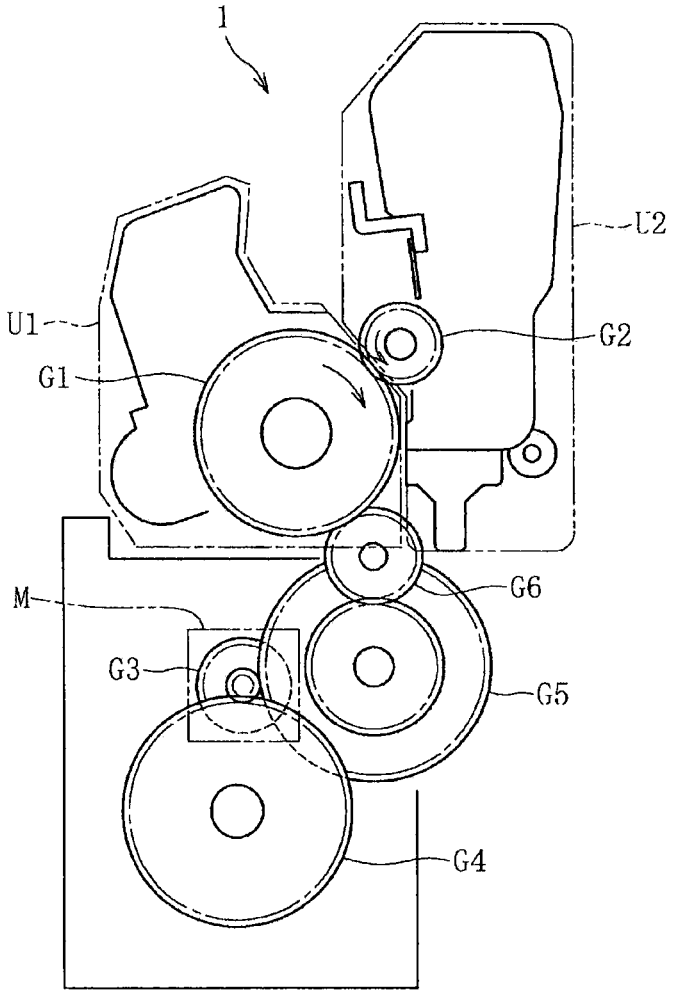
FIG. 8 shows a driving system of a photosensitive member and a developing roller.

In FIG. 8, G1 denotes a photosensitive member gear provided at one end of the photosensitive member 2 concentrically. G2 denotes a developing gear provided at one end of the developing roller 41 concentrically. The photosensitive member gear G1 and the developing gear G2 engage together, and thus, power transmission therebetween can be made. G3 denotes a driving gear of a driving motor M provided in the apparatus body 100. G4 to G6 denote plural transmission gears provided in the apparatus body 100.

When the process unit 1 is loaded into the apparatus body 100, the photosensitive member gear G1 is connected to and operates together with the driving gear G3 via the plural transmission gears G4 to G6. When the driving motor M runs in this state, the driving force is transmitted from the driving gear G3 to the photosensitive member gear G1 via the transmission gears G4 to G6, and further, is transmitted to the developing gear G2.

The degree of the engagement between the photosensitive member gear G1 and the developing gear G2 varies depending on the inter-axis distance between the center of the rotating shaft of the photosensitive member 2 and the center of the rotating shaft of the developing roller 41.

Figure 9:
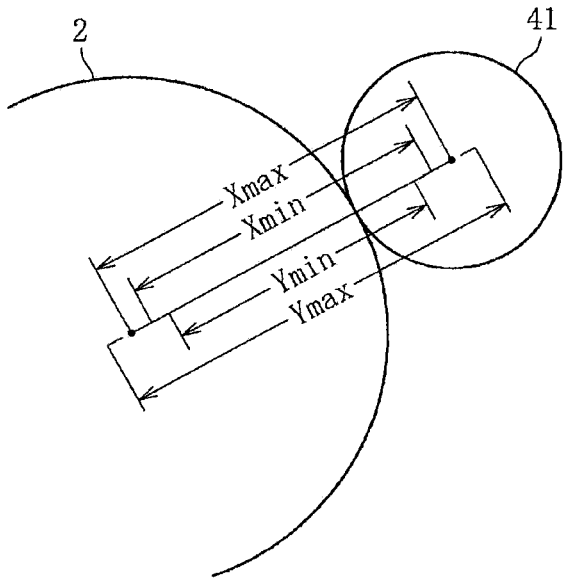
FIG. 9 shows an inter-shaft distance between the photosensitive member and the developing roller.

In FIG. 9, the minimum value and the maximum value of the inter-axis distance between the photosensitive member 2 and the developing roller 41 where the proper engagement between the photosensitive member gear G1 and the developing gear G2 can be maintained will be referred to as Ymin and Ymax, respectively. That is, Ymin denotes the minimum value of the inter-axis distance where the proper engagement between the photosensitive member gear G1 and the developing gear G2 can be maintained. Ymax denotes the maximum value of the inter-axis distance where the proper engagement between the photosensitive member gear G1 and the developing gear G2 can be maintained. Further, the minimum value and the maximum value of the inter-axis distance where the developing nip can be functionally maintained will be referred to as Xmin and Xmax, respectively. That is, Xmin denotes the minimum value of the inter-axis distance where the developing nip can be functionally maintained. Xmax denotes the maximum value of the inter-axis distance where the developing nip can be functionally maintained. Then, according to the present embodiment, a configuration is provided such that the relationship $Ymin<Xmin<Xmax<Ymax$ holds. By providing this configuration, it is possible to properly maintain the engagement of the gears automatically from setting the inter-axis distance to a distance such that the developing nip can be functionally maintained.

Below, features of the present embodiment will be described.

Figure 10:
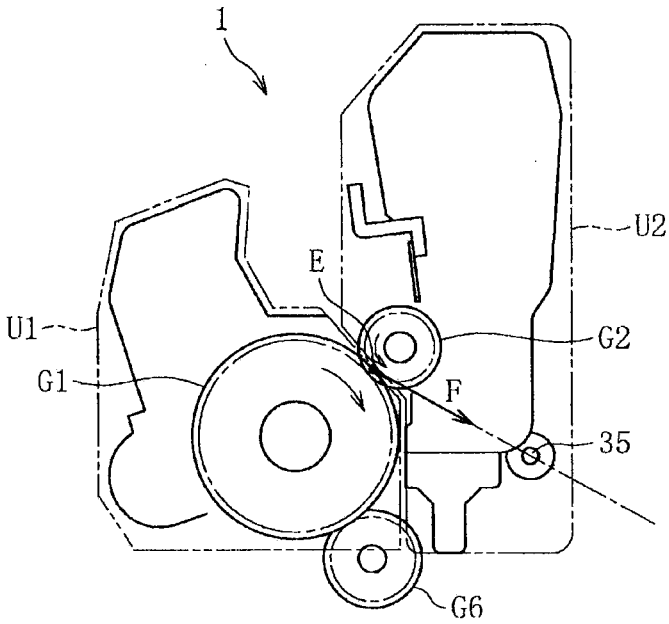
FIG. 10 shows relationship between the direction of driving force generated between gears and the rotating shaft.
Figure 11:
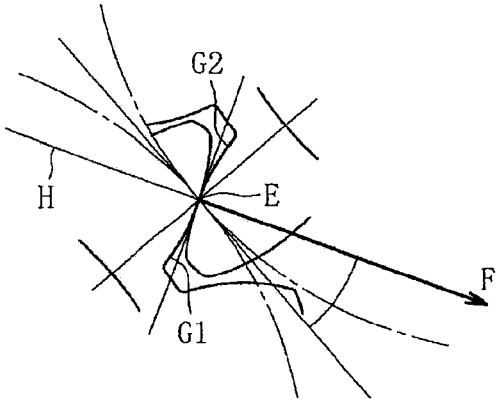
FIG. 11 shows a magnified view of a part at which the gears engage together.

As shown in FIG. 10, when the driving force is transmitted from the photosensitive member gear G1 to the developing gear G2, the driving force F is applied in the direction indicated by the arrow F of FIG. 10 at the driving force transmission part E at which the gears come into contact together. More specifically, as shown in FIG. 11, the driving force F is applied in the direction of the common normal H of the tooth planes at which the photosensitive member gear G1 and the developing gear G2 come into contact together. Then, on the vector of the driving force F generated from the engagement between the photosensitive member gear G1 and the developing gear G2 or on an extended line of the vector, the rotating shaft 35 is placed. By thus placing the rotating shaft 35 on the vector of the driving force F or on an extended line thereof, the developing unit U2 comes to be not easily rotated under the influence of the driving force F. Thus, it is possible to stabilize the state of the developing roller 41 being in contact with the photosensitive member 2.

Figure 12A:
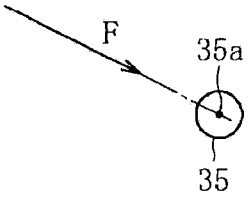
FIGS. 12A, 12B and 12C illustrate states of arranging the rotating shaft on a vector of driving force or an extended line thereof.
Figure 12B:
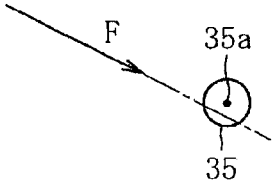
Figure 12C:
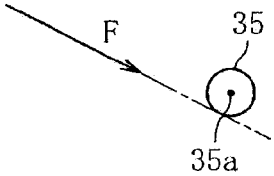

Further, the state of the rotating shaft 35 being placed on the vector of the driving force F or on an extended line thereof according to the present embodiment includes the states shown in FIGS. 12A, 12B and 12C. Hereinafter, "on the vector or on an extended line thereof" will be generally referred to as "on the vector extended line". That is, according to the present embodiment, not only the case where the vector extended line passes through the center 35*a* of the rotating shaft 35 as shown in FIG. 12A, but also the case where the vector extended line does not pass through the center 35*a* of the rotating shaft 35 but the vector extended line passes through the inside of the peripheral surface of the rotating shaft 35 as shown in FIG. 12B is included. Further, the case where the vector extended line passes on the peripheral surface of the rotating shaft 35 as shown in FIG. 12C is also regarded as the rotating shaft 35 being placed on the vector extended line.

In any one of the cases of FIGS. 12A, 12B and 12C, the rotating shaft 35 is on the vector extended line of the driving force F, and thus, the developing unit U2 comes to be not easily influenced by the driving force F. Thereamong, the case of FIG. 12A is most preferable since the developing unit U2 comes to be least easily influenced by the driving force F. The case where the developing unit U2 is second least easily influenced by the driving force F is the case of FIG. 12B.

Figure 13:
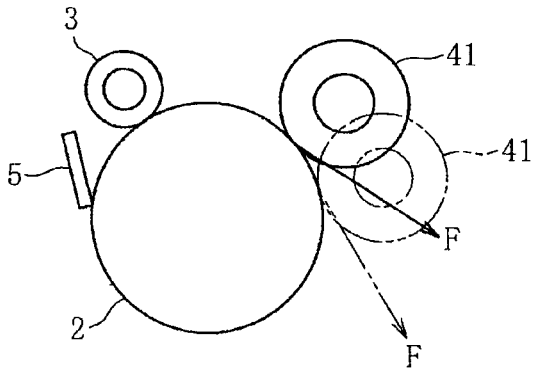
FIG. 13 shows a case where the position of the developing roller with respect to the photosensitive member is changed.

Further, as shown in FIG. 13, by changing the position of the developing roller 41 with respect to the photosensitive member 2 from the position indicated by the solid lines into the position indicated by the alternate long and two short dash lines, it is possible to change the direction of the driving force F. Thus, it is possible to place the rotating shaft 35 on the vector extended line of the driving force F, by adjusting the position or the like of the developing roller 41, depending on various layouts of the components/parts.

Figure 14:
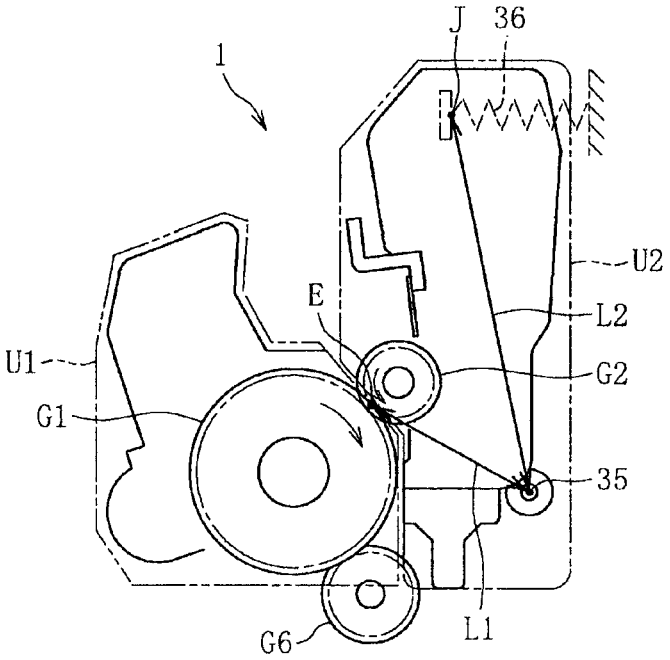
FIG. 14 shows a relationship between the distance from the center of the rotating shaft to a driving force transmission part and the distance from the center of the rotating shaft to a force applying part.

Further, in FIG. 14, L1 denotes the distance from the center of the rotating shaft 35 to the driving force transmission part E between the gears, and L2 denotes the distance from the center of the rotating shaft 35 to the force applying part J at which the force of the pressing spring 36 is applied to the developing unit U2. Then, according to the present embodiment, the relationship of L1<L2 is made to hold. Thus, by applying the spring force to the developing unit U2 at the position apart from the rotating shaft 35, it is possible to easily prevent the developing roller 41 from separating from the photosensitive member 2 even when force is generated tending to cause the developing roller 41 to separate from the photosensitive member 2. Thus, it is possible to stabilize the state of the developing roller 41 being in contact with the photosensitive member 2 more positively. Further, in comparison to a case of applying force to the developing unit U2 at a position near the rotating shaft 35, it is possible to stabilize the state of the developing roller 41 being in contact with the photosensitive member 2 even with smaller force being applied. Thus, it is possible to miniaturize the spring and/or reduce the cost of the spring.

Figure 15:
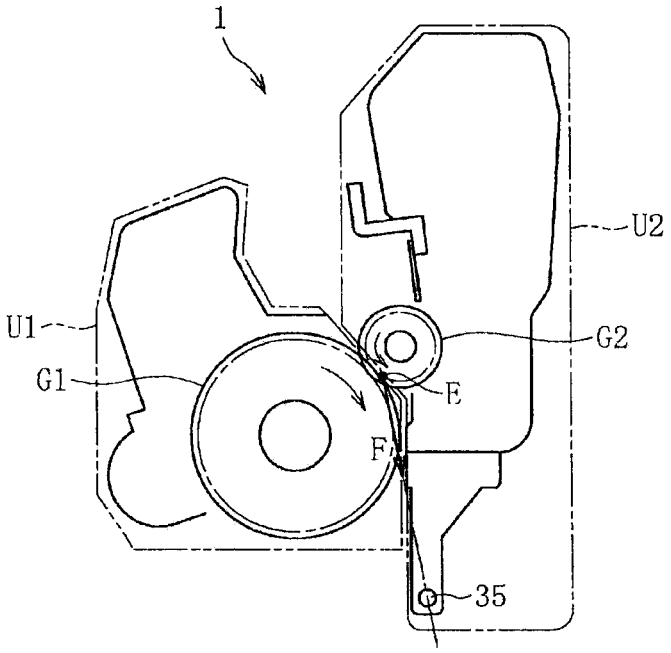
FIG. 15 shows a configuration for a case of transmitting driving force from a developing gear to a photosensitive member gear.

FIG. 15 shows a configuration for a case where, in contrast to the above-mentioned embodiment, driving force is transmitted from the developing gear G2 to the photosensitive member gear G1. It is noted that an indication of transmission gears for transmitting driving force from the apparatus body to the developing gear G2 is omitted in FIG. 15.

Figure 16:
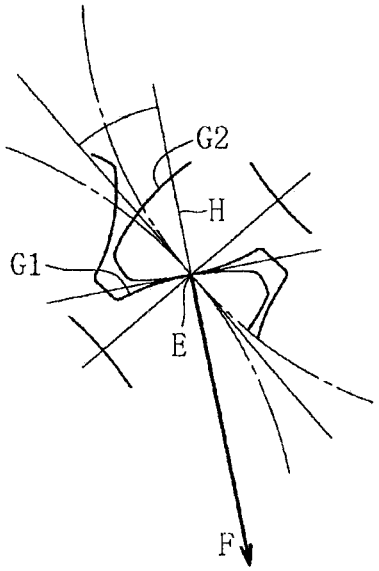
FIG. 16 shows a magnified view of a part at which the gears engage together.

As shown in FIG. 15, as a result of thus changing the direction of transmitting driving force, the direction of the driving force F applied at the driving force transmission part E at which the gears come into contact together is changed even when the position of the developing gear G2 with respect to the photosensitive member gear G1 is the same. In this case, as shown in FIG. 16, since the position at which the gears come into contact together (the position of the driving force transmission part E) is different from the case of the above-mentioned embodiment (see FIG. 11), the direction of the driving force F is changed accordingly. Specifically, the direction of the driving force F in this case faces downward more than the above-mentioned embodiment.

Also in the embodiment of FIG. 15, the same as the above-mentioned case, the developing unit U2 comes to be not easily rotated under the influence of the driving force F, by placing the rotating shaft 35 on the vector extended line of the driving force F. It is noted that generally speaking, the rotary torque of the developing gear G2 is larger than that of the photosensitive member gear G1. Thus, from the viewpoint of driving force transmissibility, transmission from the developing gear G2 to the photosensitive member gear G1 is advantageous. On the other hand, in the case of transmitting driving force from the photosensitive member gear G1 to the developing gear G2, it is possible to advantageously reduce the influence on an image caused by fluctuation of the engagement of the gears, in comparison to the case of transmitting driving force from the developing gear G2 to the photosensitive member gear G1.

Figure 17:
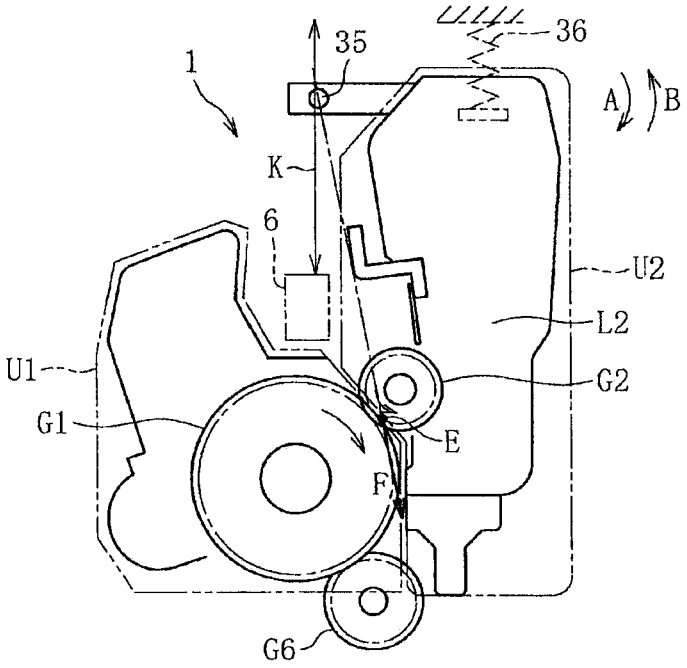
FIG. 17 shows an embodiment in which a rotating shaft of a developing device is placed on a side opposite to a vector direction of driving force with respect to a driving force transmission part.

FIG. 17 shows an embodiment in which, different from the above-mentioned respective embodiments, the rotating shaft 35 of the developing unit U2 is placed on the side opposite to the vector direction of the driving force F with respect to the driving force transmission part E. Also in this case, the developing unit U2 comes to be not easily rotated under the influence of the driving force F by placing the rotating shaft 35 on the vector extended line of the driving force F. Thus, it is possible to stabilize the state of the developing roller 41 being in contact with the photosensitive member 2. However, in this case, it is necessary to place the rotating shaft 35 and the peripheral members thereof at positions such that they do not interfere with the moving path K of the exposure device 6.

Figure 18:
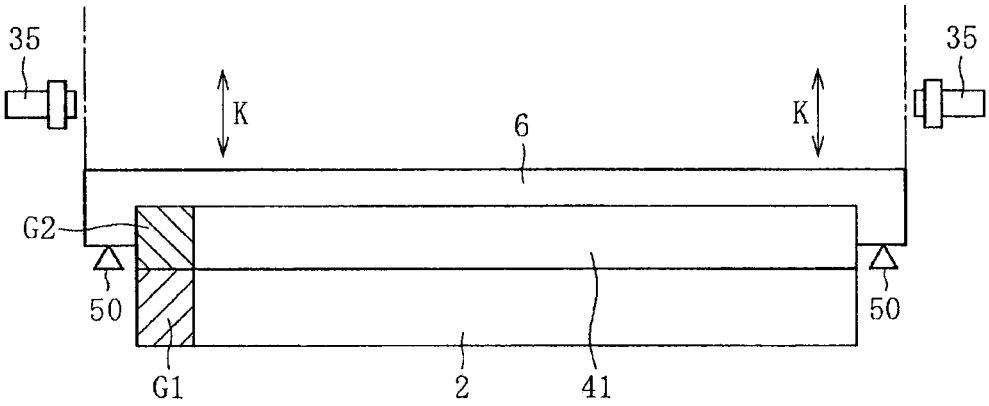
FIG. 18 shows a configuration in which a rotating shaft is placed to the outside of a width area of a moving path of an exposure device and interference thereof is avoided.

Specifically, as shown in FIG. 18, the rotating shafts 35 should be placed outside the width area of the moving path K of the exposure device 6. Generally speaking, in order to improve the positioning accuracy with respect to the photosensitive member 2, the respective end parts of the exposure device 6 as the LED unit are made to come into contact with holding points 50 provided at a frame that holds the photosensitive member 2. For this purpose, the exposure device 6 is made longer in size than the axis-direction length of the photosensitive member 2. However, when the rotating shafts 35 of the developing unit U2 are placed outside the moving path K of the exposure device 6 in order to avoid interference with the exposure device 6 that is made long in size, the longitudinal-direction length of the process unit 1 is increased by the same amount.

In order to avoid the increase in the size of the process unit 1, it is preferable to place the rotating shaft 35 of the developing unit U2 to the same side as the vector direction of the driving force F with respect to the driving force transmission part E, as in the embodiments shown in FIGS. 10 and 15. Thus, it is possible to place the rotating shaft 35 at a position different from the moving path K of the exposure device 6 even without increasing the size of the process unit 1. Thus, it is possible to contribute to a miniaturization of the printer.

Thus, according to the embodiments, it is possible to avoid a rotation of the developing unit U2 by placing the rotating shaft 35 of the developing unit U2 on the vector extended line of the driving force F that is generated from the engagement between the photosensitive member gear G1 and the developing gear G2. Thus, it is possible to stably maintain the relative position of the developing roller 41 with respect to the photosensitive member 2, and thus, it is possible to stably obtain a satisfactory image.

Especially, by placing the rotating shaft 35 of the developing unit U2 on the same side as the vector direction of the driving force F with respect to the driving force transmission part E, it is possible to achieve miniaturization of the printer along with avoiding interference between the rotating shaft 35 and the exposure device 6.

Further, in the cases of the embodiments, different from a system of fixing the inter-axis distance between the photosensitive member 2 and the developing roller 41, it is possible to stabilize the relative position of the developing roller 41 with respect to the photosensitive member 2, even without providing an inter-axis adjustment mechanism, carrying out strict inter-axis management or the like.

According to the embodiments, in consideration of the above-mentioned problem concerning Patent Reference No. 1, it is possible to provide the process unit and the image forming apparatus including the process unit, by which it is possible to stably maintain the relative position of the developer carrying member with respect to the photosensitive member.

More specifically, according to the embodiments, the rotating shaft supporting the developing device is placed on the driving force vector between the gears generated from engagement between the photosensitive member gear and the developing gear or on an extended line of the driving force vector. Thus, the developing device is made not to be easily rotated under the influence of the driving force. Thus, it is possible to stably maintain the relative position of the developer carrying member with respect to the photosensitive member.

Thus, the process unit and the image forming apparatus have been described by the embodiments. However, the present invention is not limited to these specifically disclosed embodiments, and variations and modifications may be made without separating from the scope of the present invention. In the above-described embodiments, the cases where the LED units are used as the exposure devices have been described as examples. However, the present invention can also be applied to a configuration using a writing unit that has a laser light source, a revolving mirror such as a polygon mirror and so forth.

The present application is based on Japanese Priority Application No. 2012-036397 filed on Feb. 22, 2012, and Japanese Priority Application No. 2012-259981 filed on Nov. 28, 2012, the entire contents of which are hereby incorporated herein by reference.

What is claimed is:

1. A process unit comprising:

a photosensitive member that carries an image;

a developing device that has a developer carrying member carrying a developer to be supplied to the photosensitive member;

a rotating shaft that supports the developing device rotatably for allowing the developer carrying member to approach and separate from the photosensitive member;

a photosensitive member gear provided to the photosensitive member; and a developing gear provided to the developer carrying member, wherein the photosensitive member gear and the developing gear engage together and a driving force can be transmitted, and the rotating shaft is placed on a driving force vector between the gears or on an extended line thereof such that the rotating shaft is located on a same side of the gears as a direction of the driving force vector, the driving force vector being generated from engagement between the photosensitive member gear and the developing gear.

2. The process unit as claimed in claim 1, wherein the rotating shaft is placed in such a manner that the driving force vector or the extended line thereof passes on a peripheral surface of the rotating shaft or passes through the inside of the peripheral surface.

3. The process unit as claimed in claim 1, wherein a driving force is transmitted from the photosensitive member gear to the developing gear.

4. The process unit as claimed in claim 1, wherein a driving force is transmitted from the developing gear to the photosensitive member gear.

5. The process unit as claimed in claim 1, wherein

Xmin and Xmax respectively denote a minimum value and a maximum value of an inter-axis distance between the photosensitive member and the developer carrying member where a nip formed between the photosensitive member and the developer carrying member can be functionally maintained, Ymin and Ymax respectively denote a minimum value and a maximum value of the inter-axis distance between the photosensitive member and the developer carrying member where the photosensitive member gear and the developing gear can maintain proper engagement, and a relationship $Ymin<Xmin<Xmax<Ymax$ holds.

6. The process unit as claimed in claim 1, wherein the rotating shaft is provided to the developing device.

7. An image forming apparatus comprising:

the process unit claimed in claim 1.

8. An image forming apparatus comprising:

at least one of the process unit of claim 1.

9. The process unit as claimed in claim 1, wherein a configuration is made to apply a force to the developing device in a direction such that the developer carrying member approaches the photosensitive member, L1 denotes a distance from a center of the rotating shaft to a driving force transmission part at which the driving force is applied between the gears, L2 denotes a distance from the center of the rotating shaft to a force applying part at which the force is applied to the developing device, and a relationship $L1<L2$ holds.

10. A process unit comprising:

a photosensitive member that carries an image;

an exposure device that approaches toward and separates from the photosensitive member in a moving path;

a developing device that has a developer carrying member carrying a developer to be supplied to the photosensitive member;

a rotating shaft that supports the developing device rotatably for allowing the developer carrying member to approach and separate from the photosensitive member;

a photosensitive member gear provided to the photosensitive member; and a developing gear provided to the developer carrying member, wherein the photosensitive member gear and the developing gear engage together and a driving force can be transmitted, the rotating shaft is placed on a driving force vector between the gears or on an extended line thereof, the driving force vector being generated from engagement between the photosensitive member gear and the developing gear, and a rotational axis of the rotating shaft is on the moving path of the exposure device.

11. The process unit as claimed in claim 10, wherein the rotating shaft is on a side opposite a vector direction of the driving force vector.

12. The process unit as claimed in claim 11, wherein the rotating shaft is outside the moving path of the exposure device.

13. An image forming apparatus comprising:

the process unit claimed in claim 11.

14. A process unit comprising:

a photosensitive member that carries an image;

an exposure device that approaches toward and separates from the photosensitive member;

a developing device that has a developer carrying member carrying a developer to be supplied to the photosensitive member;

a rotating shaft that supports the developing device rotatably for allowing the developer carrying member to approach and to separate from the photosensitive member;

a photosensitive member gear provided to the photosensitive member; and a developing gear provided to the developer carrying member, wherein the photosensitive member gear and the developing gear engage together and a driving force can be transmitted, the rotating shaft is placed on a driving force vector between the gears or on an extended line thereof, the driving force vector being generated from engagement between the photosensitive member gear and the developing gear, and the exposure device, a rotational axis of the rotating shaft and the photosensitive member gear are in a straight line such that the exposure device is between the rotational axis of the rotating shaft and the photosensitive member gear.

15. The process unit as claimed in claim 14, wherein the rotating shaft is on a side opposite a vector direction of the driving force vector.

16. The process unit as claimed in claim 14, wherein the rotating shaft is outside a width of the exposure device.

17. An image forming apparatus comprising:

the process unit claimed in claim 14.

* * * * *